US005445222A

United States Patent [19]

Pritchard et al.

[11] Patent Number: 5,445,222

[45] Date of Patent: Aug. 29, 1995

[54] WHIPSTOCK AND STAGED SIDETRACK MILL

[75] Inventors: Michael D. Pritchard; James R. McCain; Gary R. McCain; Mark D. Bright, all of Bakersfield, Calif.

[73] Assignee: Shell Oil Company, Houston, Tex.

[21] Appl. No.: 260,158

[22] Filed: Jun. 7, 1994

[51] Int. Cl.[6] ..... E21B 7/08; E21B 29/06; E21B 10/26

[52] U.S. Cl. ..... 116/298; 166/55.1; 166/55.7; 166/117.5; 175/79; 175/391

[58] Field of Search ..... 166/55.1, 55.7, 117.5, 166/117.6, 298; 175/391, 385, 386, 388, 394, 425, 61

[56] References Cited

U.S. PATENT DOCUMENTS

| | | | |
|---|---|---|---|
| 1,387,447 | 8/1921 | Alford | 175/391 X |
| 2,124,414 | 7/1938 | Goldman | 175/391 X |
| 3,330,349 | 7/1967 | Owsley et al. | 166/117.5 X |
| 4,266,621 | 5/1981 | Brock | 175/385 X |
| 4,397,360 | 8/1983 | Schmidt | 175/61 |
| 4,765,404 | 8/1988 | Bailey et al. | 166/117.6 |
| 5,109,924 | 5/1992 | Jurgens et al. | 166/117.5 |
| 5,113,938 | 5/1992 | Clayton | 166/117.6 |
| 5,199,513 | 4/1993 | Stewart et al. | 175/73 |
| 5,277,251 | 1/1994 | Blount et al. | 166/117.5 |

OTHER PUBLICATIONS

Advertisement by The Servco Company, 1957 Composite Catalog, one page.

Advertisement by Lor, Inc. International, starting mill typcial example, one page.

Indated brochure from A-Z Grant, International, three pages.

Eastman Oil Well Survey Company, Composite Catalog of Oil Field Equipment & Services, 29th Revision 1970-71, vol. 2, one page.

Drilex Systems, Inc., Composite Catalog of Oil Field Equipment & Services, 1988-89, vol. 1, one page.

*Primary Examiner*—Stephen J. Novosad

*Attorney, Agent, or Firm*—Del S. Christensen

[57] ABSTRACT

A sidetrack mill is provided for drilling through a cased borehole to provide a sidetracked wellbore having a final diameter, the mill comprising: a pilot mill having a tapered cutting surface being, at its largest diameter, between about 50% and about 75% of the final diameter; a second stage cutting surface being, at its smallest diameter about the diameter of the maximum diameter of the pilot mill, and being at its largest diameter, at least five percent greater in diameter than the largest diameter of the pilot mill; and a final stage cutting surface being, at its largest diameter, about the final diameter, and at the smallest cutting surface diameter, being a diameter of at least about 5% smaller than the final diameter. This mill is can rapidly penetrated casings without requiring excessive torque. The milling can be accomplished with a single trip. In another aspect of the present invention, a method is provided to provide a sidetracked wellbore through a cased borehole the sidetracked wellbore having a final diameter, the method comprising: providing a whipstock, the whipstock comprising an elongated wedge shaped body having a wedge surface of a hardness greater than the casing, and less than tungsten carbine; securing the whipstock in the borehole with wellbore cement; and milling a window in the casing by rotating a mill having tungsten carbine cutting elements in the wellbore along the wedge surface of the whipstock. The staged mill described above is preferably utilized in this method.

19 Claims, 2 Drawing Sheets

FIG. 1A
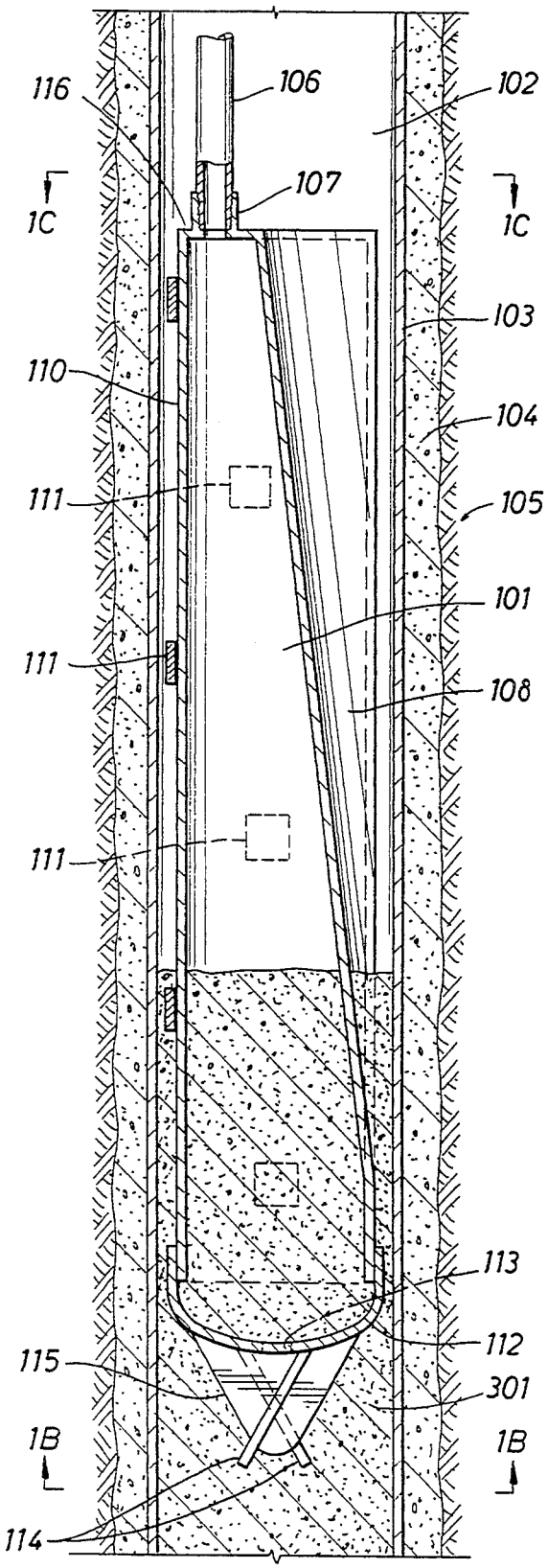
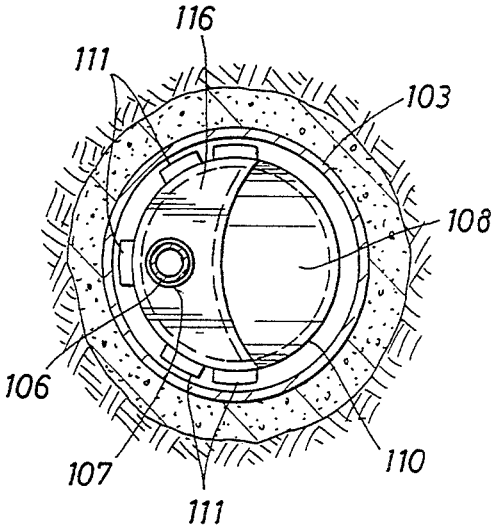
FIG. 1C
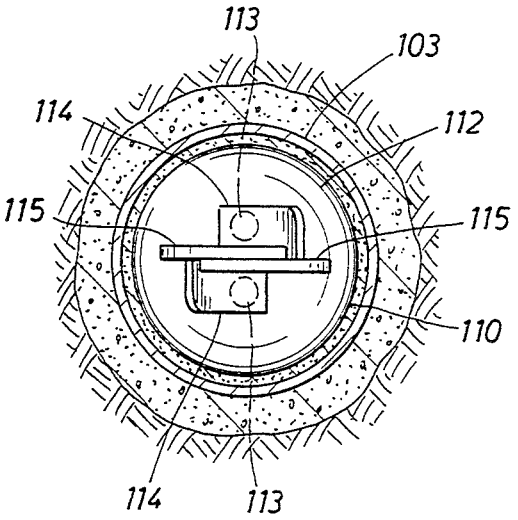
FIG. 1B

WHIPSTOCK AND STAGED SIDETRACK MILL

FIELD OF THE INVENTION

This invention relates to an improved whipstock and mill for sidetracking through a cased wellbore.

BACKGROUND TO THE INVENTION

Wellbores drilled to subterranean formations to produce oil or gas often become unusable before the formation is depleted of recoverable oil or gas. For example, equipment may become lodged in the wellbore above or in production zones, preventing access to the production zones with pumps, logging and workover equipment. Production from a wellbore also becomes impaired over time. Some of this impairment is due to fines migrating with the formation fluids toward the wellbore. Scale can also be deposited by formation water near the wellbore because temperatures and pressures can be lower near the wellbore, resulting in decreased solubility of some dissolved components.

When a borehole becomes unusable, either a new well can be drilled from the surface, or the existing borehole can be used to the extent it remains serviceable, and a new borehole can be sidetracked from the bottom of this seviceable section. Sidetracking is often preferred because drilling, casing and cementing the serviceable portion of the wellbore is avoided. Sidetracking involves milling through a steel casing and doing so in a matter that does not create a sudden change in direction, or dog leg, in the wellbore. This has generally been attempted by either milling out an entire section of the casing, and then drilling through the side of the open hole, or by drilling through the side of the casing with a mill bit that is guided by a wedge called a "whipstock."

Attempts to drill through the side of a casing are often unsuccessful because either a dog leg is created, making the sidetracked wellbore unusable, the mill never gets outside of the casing, or the milling of the casing is simply to slow. Whipstocks typically used for these operations are also expensive. U.S. Pat. No. 4,765,404 discloses a whipstock typical of those used. This whipstock is locked in place and held by a packer assembly below the whipstock. A substantial packer is required to keep the whipstock from rotating or moving downward when the casing is being milled. This packer adds substantially to the cost of the sidetracking operation because it must be left in the abandoned portion of the wellbore when the sidetracking operation is complete.

Casings are considerably more difficult to penetrate than in situ formations, therefore, a mill is necessary to bore through steel casings. Ideal conditions for milling require high RPM's and adjusted bottom hole weight to sustain the RPM's. Many mills, because of their contact surface area, grab and bind against the milling surface slowing the RPM's and creating abnormal torque and recoil to the drill string and drilling rig. To eliminate this it is necessary to lessen the bottom hole weight which reduces milling time, or begin with a smaller mill and make multiple trips to obtain desired results. U.S. Pat. No. 5,199,513 discloses sidetracking mills that exemplify these problems. These mills cut through the casing with a single cutting stage, maximizing the torque required and the heat generated at the point the milling is occurring.

Milling a complete section of the casing and then sidetracking through the casingless wellbore wall is a more reliable method to sidetrack, but milling of the entire section of casing is very time consuming. Further, the success rate of such operations is often low because of the difficulty of sidetracking out of the wellbore before casing is again encountered below the open borehole.

It is therefore an object of the present invention to provide a reliable and inexpensive method to provide a sidetrack wellbore. In another aspect, it is an object of the present invention to provide a mill for penetrating a casing within a wellbore wherein the mill rapidly penetrates the casing without requiring an excessive amount of torque, and wherein the casing can be milled in a single operation.

SUMMARY OF THE INVENTION

These and other objects are achieved by a sidetrack mill for drilling through a cased borehole to provide a sidetracked wellbore having a final diameter, the mill comprising:

a pilot mill having a tapered cutting surface being, at its largest diameter, between about 50% and about 75% of the final diameter;

a second stage cutting surface being, at its smallest diameter about the diameter of the maximum diameter of the pilot mill, and being at its largest diameter, at least five percent greater in diameter than the largest diameter of the pilot mill; and a final stage cutting surface being, at its largest diameter, about the final diameter, and at the smallest cutting surface diameter, being a diameter of at least about 5% smaller than the final diameter. This mill can rapidly penetrate casings without requiring excessive torque. The milling can be accomplished with a single trip.

In another aspect of the present invention, a method is provided to provide a sidetrack wellbore through a cased borehole the sidetracked wellbore having a final diameter, the method comprising:

providing a whipstock, the whipstock comprising an elongated wedge shaped body having a wedge surface of a hardness greater than the casing, and less than tungsten carbine;

securing the whipstock in the borehole with wellbore cement; and milling a window in the casing by rotating a mill having tungsten carbine cutting elements in the wellbore along the wedge surface of the whipstock. The staged mill described above is preferably utilized in this method.

BRIEF DESCRIPTION OF THE DRAWINGS

FIG. 1A is a cross sectional view of a whipstock of the present invention in a wellbore that is to be sidetracked.

FIG. 1B is a view from below of a whipstock.

FIG. 1C is a view from above of a whipstock.

DETAILED DESCRIPTION OF THE INVENTION

Figure 2:
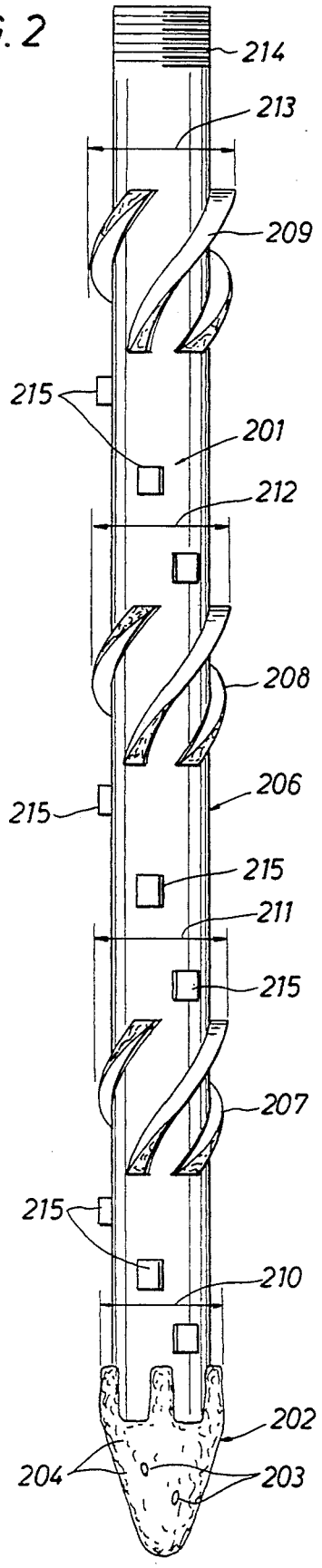
FIG. 2 is a profile view of a staged mill.

Referring now to FIGS. 1A, 1B and 1C, a whipstock, 101, in a wellbore, 102, is shown. The wellbore is cased with a casing, 103, which is cemented in place by a wellbore cement, 104, between the casing and the formation, 105, in which the casing is placed. The method of the present invention may be applied to uncemented casings due to the fact that stability is maintained for the remaining or unmilled portion of the target casing by the cemented whipstock. Conventional section milling normally fails when the casing is uncemented. Due to the fact that when the first cut is achieved, and the casing separates, the lower section begins moving in the original hole diameter. This creates severe torque and failure of the mill, casing, and loss of the wellbore. Using the method of the present invention, uncemented casings have been successfully sidetracked. The whipstock is suspended from a string of tubulars, 106, threaded into a threaded coupling, 107, located on the top side of the whipstock. To enable removal of the drill string after the whipstock is placed, 106 and 107 are shown as left-handed tubing threads. A J-hook connection or hydraulic release could alternatively be used to connect the tubulars to the top of the whipstock. The whipstock has an angled guide section, 108, that is effective for guiding a mill out the side of the casing, 103. This angled guide section ia an elongated wedge surface. The direction which the mill is guided out of the side of the casing can be controlled by placement of the whipstock within the wellbore in a known orientation. The guide section can be a section of a pipe so that it matches the diameter of a mill which is to be used in subsequent milling. The guide section is preferably made of a material that is harder than the casing, 103, but not as hard as the cutting elements of the mill. If the guide were not harder than the casing, the mill would continue downward and penetrate into the whipstock rather than exit the casing. The mill will generally be pressed against the guide with greater force than it is pressed against the casing and the difference in hardness between the casing and the guide must be sufficient to overcome this excess force.

The guide, 108, is supported by a body, 110, that maintains the guide at the correct angle relative to the casing. Wear pads, 111, are attached to the body, 110, to maintain separation between the casing and the body, to provide stability for the casing in the wellbore, and to avoid creating excessive friction when the whipstock is lowered into the wellbore. This separation, preferably between about one-quarter and about one-half inches, depending on the internal diameter of the casing, 103, and the external diameter of the whipstock body, 110. The separation allows fluids to pass from under the whipstock to above the whipstock when the whipstock is lowered into the borehole.

The bottom of the whipstock is enclosed by a cap, 112. The cap, 112, defines two cement circulation ports, 113, for circulating cement or other fluids through the body of the whipstock. Legs, 114, supported by braces, 115, are shown at the bottom of the cap, 113. The legs, 114 and braces, 115, help anchor the whipstock in cement to prevent movement during milling.

The top of the whipstock is enclosed by a plate, 116. The whipstock therefore forms a conduit between the threaded coupling, 107, and the ports, 113, that allows cement slurry to be pumped through the whipstock to below the whipstock. Alternatively, the whipstock could be pushed into green cement.

The whipstock is shown, in FIG. 1A, as it would be after being set into green cement. Green cement could enter the body, 110, but sufficient support for the whipstock could be provided if just a portion of the legs, 119, submerged into the green cement.

Referring now to FIG. 2, a staged mill, 201, is shown. This mill has a tapered mill, 202, at its end. The tapered mill defines openings, 203, for circulating drilling fluids through for cooling the mill during milling and to carry off cuttings. The tapered mill is preferably a cone-shaped mill that has an outer diameter of about 50% to about 75% of the maximum diameter to which the sidetracked hole will be completed. This diameter significantly reduces the torque required to rotate the mill at a speed that will result at an acceptable rate. The cutting elements, 204, are preferably tungsten carbide chips brazed onto a cone-shaped head.

A longitudinal body, 206, for support of the cutting elements of the staged mill may be any relatively stiff tubular. A thirty foot long drilling collar is acceptable. Stages, 207, 208, and 209, of cutting surfaces are located above the tapered mill, 202. Each successive stage, going up the mill, increases in maximum cutting diameter. The maximum cutting diameter of the tapered mill, 202, is shown as dimension 210. The second stage cutting surface, 207, is shown having a maximum cutting diameter of 211. The maximum cutting diameter of the third and fourth stage cutting surfaces are shown as dimensions 212 and 213 respectively. The cutting diameter of the second stage cutters at the lower end is about the same diameter as the maximum cutting diameter of the taper mill. The difference between the maximum cutting diameters of successive stages is preferably between about one-half and about 1½ inches, with the maximum cutting diameters increasing with each successive stage. This represents at least about 5% increases in the largest cutting diameters for each successive stage. The cutting diameter of each successive stage is preferably the maximum diameter of the previous stage at the lead end and increased about one inch over the length of the stage to the tail end.

FIG. 2 shows three stages and the taper mill. Additional stages could reduce the size of the increments of between cutting diameters of successive stages. At least three stages are preferred, and three or four stages (including the taper mill) are particularly preferred. Two stages result in only marginal improvement over the prior art, and more than four stages increases the cost of the staged mill with minimal improvements in performance.

The upper end of the staged mill, 214, can be threaded to provide a standard connection to a drilling string. The staged mill can be lowered into a wellbore and rotated using common drilling methods. Drilling fluids can be circulated through the drilling string, into the center of the staged mill, and out the openings, 203, of the tapered mill. Additional nozzles for circulation of a drilling fluid directly to other stages can also optionally be provided. Wear pads, 215, are shown between cutting stages, extending the diameter of the longitudinal body to about the maximum cutting diameter of the preceding stage. These wear pads maintain the longitudinal body centralized in the sidetrack wellbore.

The initial milling stage is shown and referred to as a tapered mill, but other configurations of mills can be effectively utilized, as is known in the art. The advantage of the present invention is the multiple stage arrangement, allowing the initial stage to be considerably smaller than those of the prior art, coupled with successive stages that permit the sidetracked wellbore to be created in one trip rather than multiple passes with different mills, or with one full-size mill.

Cutting stages above the initial stage are shown as spiraled raised ridges with cutting elements such as tungsten carbine brazed to the outer portions of the ridges. Other configurations could also be utilized, but the spiral fins are preferred.

The distances between successive stages are preferably sufficient so that no more than two stages are milling casing at the same time as the staged mill is creating a sidetrack wellbore through a cased borehole.

Figure 3:
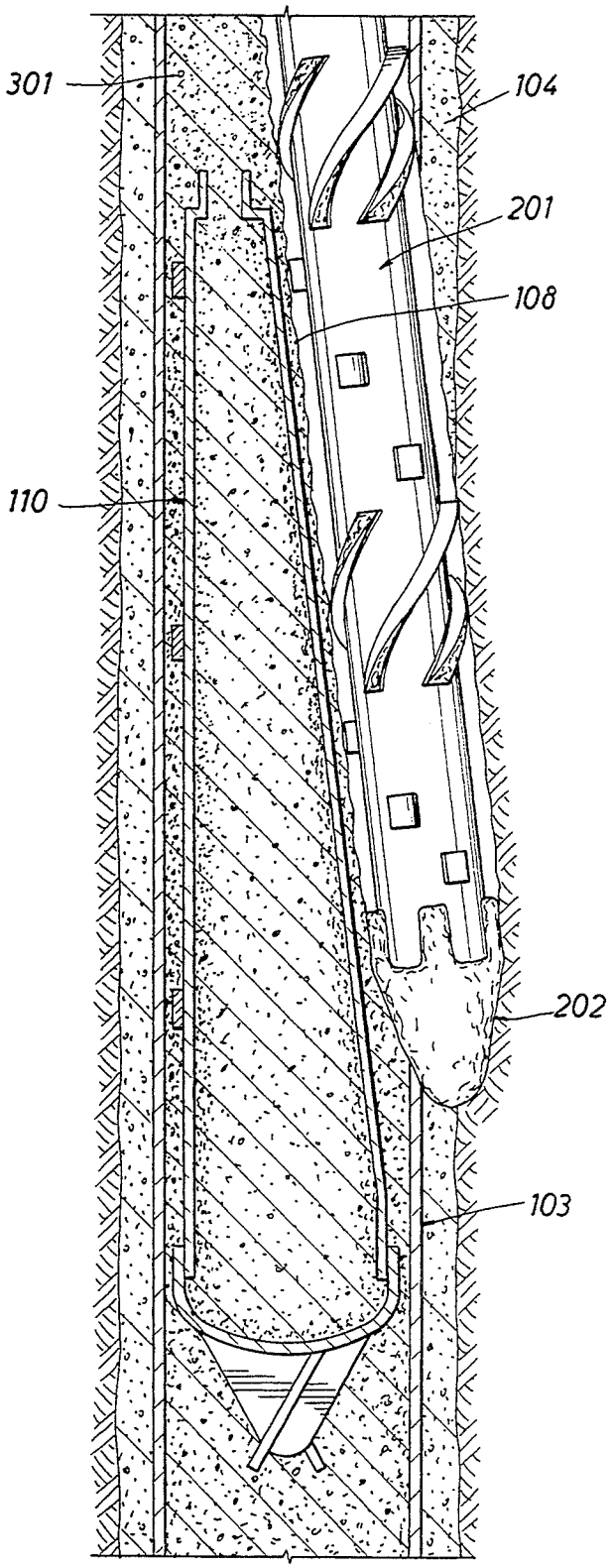
FIG. 3 is a cross sectional view of a whipstock cemented in a wellbore with a staged mill partially drilled through a side of the wellbore.

Referring now to FIG. 3, with like elements numbered as in FIG. 1A and FIG. 2, a staged mill is shown milling a sidetrack wellbore from a cased borehole having a whipstock cemented into the borehole. The whipstock could be placed in the wellbore suspended from a drillstring, and then cement slurry circulated down the drillstring to seal off the borehole below the whipstock and to create a support for the whipstock. After cement slurry has been placed below the whipstock, the whipstock will remain at that location in the wellbore because the slurry is generally too viscous to pass around the whipstock through the limited space between the body of the whipstock, 110, and the casing, 103. The drill string (not shown) can then be disconnected from the whipstock and lifted. Additional cement, 301, can be placed on top of the whipstock from the drillstring after the drillstring is disconnected from the whipstock. This additional cement helps secure the whipstock in the casing during milling, but is typically not necessary to secure the whipstock in place. The sidetracked wellbore must be drilled through this cement, but wellbore cement is relatively soft and can be penetrated quickly with a mill or drill bit.

The guide, 108, is partially removed by the mill, 201, because the guide is preferably made of a material that is harder than the casing but not as hard as the cutting elements of the mill. Later stages of a staged mill may remove substantial portions of the guide, but because the guide was effective to direct the taper mill through the casing, it does not matter if later stages remove substantial portions of the guide.

The whipstock is preferably set in cement by circulating cement slurry through the whipstock, but other methods of setting the whipstock in cement can be used. The whipstock could be forced into green cement slurry, or released form the wellhead and allowed to free fall onto green cement slurry.

We claim:

1. A sidetrack mill for drilling through a cased borehole to provide a sidetracked wellbore having a final diameter, the mill comprising:

a pilot mill having a tapered cutting surface being, at its largest diameter, between about 50% and about 75% of the final diameter;

a second stage cutting surface being, at its smallest diameter about the diameter of the maximum diameter of the pilot mill, and being at its largest diameter, at least five percent greater in diameter than the largest diameter of the pilot mill; and a final stage cutting surface being, at its largest diameter, about the final diameter, and at the smallest cutting surface diameter, being a diameter of at least about 5% smaller than the final diameter, wherein each of the stages are placed along a drive and separated along the drive by a distance at least five times the final diameter.

2. The mill of claim 1 further comprising a third stage cutting surface located along the drive between the second stage cutting surface add the final stage cutting surface, the third stage cutting surface having a largest diameter of about the smallest cutting diameter of the final stage, and having a smallest cutting diameter of at least about 5% smaller than the its largest diameter.

3. The mill of claim 1 wherein the second stage and final stage cutting surfaces are spiraling raised ridges.

4. The mill of claim 1 wherein the drive is a drilling collar.

5. The mill of claim 4, further comprising a plurality of wear pads located between each adjacent stage, with each of the wear pads having a wear surface along an outer circumference at a corresponding to about the maximum diameter of the adjacent cutting surface having the smallest maximum cutting diameter.

6. The mill of claim 1 wherein each of the stages are placed along a drive and separated along the drive by a distance of between about ten and about twenty times the final diameter.

7. The mill of claim 1 wherein each successive stage has a maximum diameter of at least about one half of an inch greater than the preceding stage.

8. A method to provide a sidetracked wellbore through a cased borehole the sidetracked wellbore having a final diameter, the method comprising:

providing a whipstock, the whipstock comprising an elongated wedge shaped body having a wedge surface of a hardness greater than the casing, and less than tungsten carbide;

securing the whipstock in the borehole with wellbore cement; and milling a window in the casing by rotating a mill in the wellbore along the wedge surface of the whipstock.

9. The method of claim 8 wherein the whipstock further comprises a channel for routing fluids from a drillstring above the whipstock to a port below the whipstock.

10. The method of claim 9 wherein the whipstock is placed within the wellbore by lowering the whipstock from a drillstring, and the whipstock is secured in the borehole by placing cement into the wellbore below the whipstock by pumping the cement through the drillstring, through the whipstock and out the port below the whipstock.

11. The method of claim 10 wherein, after the cement is placed into the borehole below the whipstock, the drillstring is disconnected from the whipstock and additional cement is placed on top of the whipstock from the drillstring.

12. The method of claim 8 wherein the mill comprises:

a pilot mill having a tapered cutting surface being, at its largest diameter, between about 50% and about 75% of the final diameter;

a second stage cutting surface being, at its smallest diameter about the diameter of the maximum diameter of the pilot mill, and being at its largest diameter, at least five percent greater in diameter than the largest diameter of the pilot mill; and a final stage cutting surface being, at its largest diameter, about the final diameter, and at the smallest cutting surface diameter, being a diameter of at least about 5% smaller than the final diameter.

13. The method of claim 12 wherein each of the stages of the mill are placed along a drive and separated along the drive by a distance at least five times the final diameter.

14. The method of claim 13 wherein the mill further comprises a third stage cutting surface located along the drive between the second stage cutting surface and the final stage cutting surface, the third stage cutting surface having a largest diameter of about the smallest cutting diameter of the final stage, and having a smallest cutting diameter of at least about 5% smaller than the its largest diameter.

15. The method of claim 12 wherein the second stage and final stage cutting surfaces are spiraling raised ridges.

16. The method of claim 12 wherein the drive is a drilling collar.

17. The method of claim 16, wherein the mill further comprises a plurality of wear pads located between each adjacent stage, with each of the wear pads having a wear surface along an outer circumference at a corresponding to about the maximum diameter of the adjacent cutting surface having the smallest maximum cutting diameter.

18. The method of claim 12 wherein each of the stages are placed along a drive and separated along the drive by a distance of between about ten and about twenty times the final diameter.

19. The method of claim 12 wherein each successive stage has a maximum diameter of at least about one half of an inch greater than the preceding stage.

* * * * *